United States Patent [19]

Lea

[11] 3,940,112

[45] Feb. 24, 1976

[54] CROWN BLOCK

[75] Inventor: Freeman Roderick Lea, Orange, Calif.

[73] Assignee: Santa Fe International Corporation, Los Angeles, Calif.

[22] Filed: Nov. 29, 1973

[21] Appl. No.: 420,255

[52] U.S. Cl. ..... 254/190 B; 254/188

[51] Int. Cl.[2] ..... B66D 1/36

[58] Field of Search..... 254/188, 189, 190 B, 145, 254/139, 172

[56] References Cited

UNITED STATES PATENTS

| | | | |
|---|---|---|---|
| 1,833,172 | 11/1931 | Minor | 254/190 B |
| 1,928,958 | 10/1933 | Young et al. | 254/188 |
| 2,440,427 | 4/1948 | Bender | 254/190 B |
| 2,601,611 | 6/1952 | Hilborn et al. | 254/188 |
| 2,734,718 | 2/1956 | Minor | 254/188 |
| 2,737,367 | 3/1956 | Woolslayer et al. | 254/190 B |
| 2,766,009 | 10/1956 | Wilson | 254/188 |
| 2,975,601 | 3/1961 | Thorson | 254/190 B |
| 3,366,366 | 1/1968 | Arthur | 254/190 B |
| 3,652,058 | 3/1972 | Ashton | 254/190 B |

*Primary Examiner*—Robert J. Spar
*Assistant Examiner*—Kenneth Noland
*Attorney, Agent, or Firm*—LeBlanc & Shur

[57] ABSTRACT

Disclosed is an open center crown block pivotally mounting a pair of sheaves on each of the opposite sides of the well centerline. On one side of the crown block, there is pivotally mounted a crossover sheave for transferring the drilling line from one side of the well centerline to the opposite side thereof. Opposite the crossover sheave is a fastline sheave for aligning the drilling line from the draw works vertically above the travelling block. On another side of the frame, there is provided a deadline sheave for transferring the drilling line from the crown block to an anchor point on the mast or substructure. The crossover, fastline and deadline sheaves are spaced from the well centerline leaving the central portion of the crown block clear for receiving motion compensators or other drilling equipment thereby rendering unnecessary any increase in height of the mast in order to receive the compensator or other tools.

27 Claims, 5 Drawing Figures

FIG. 2
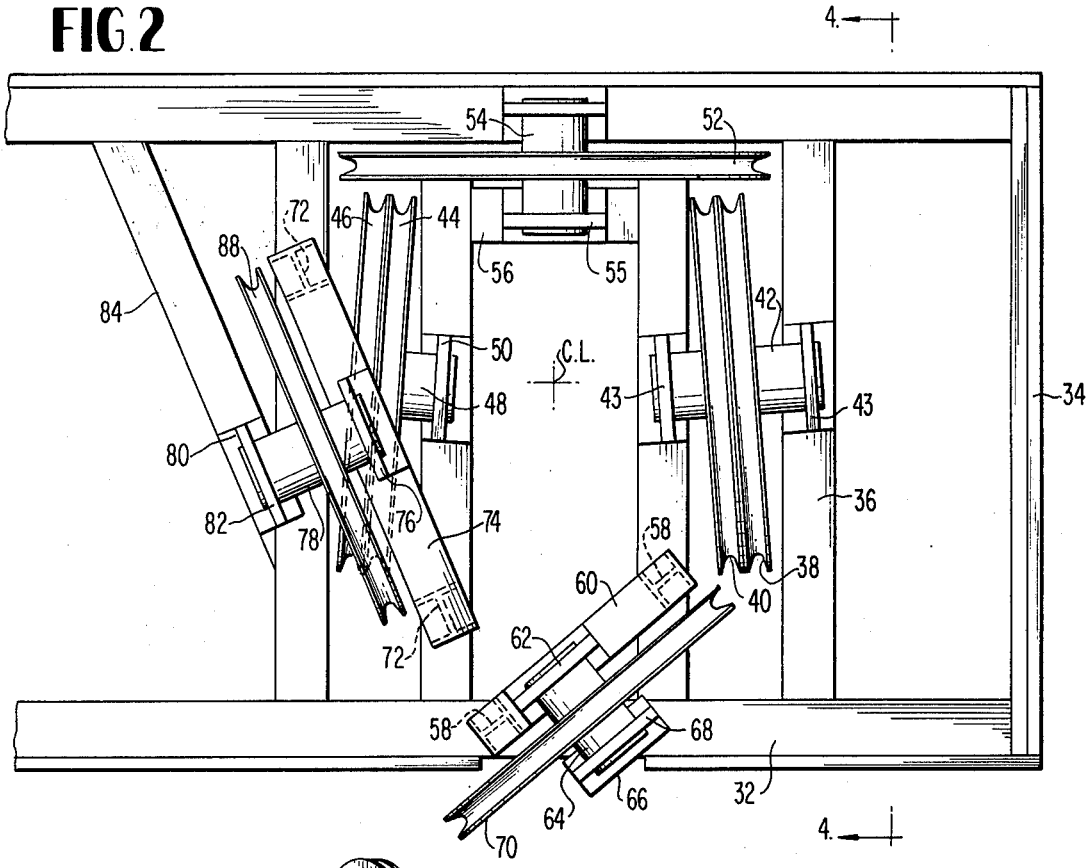
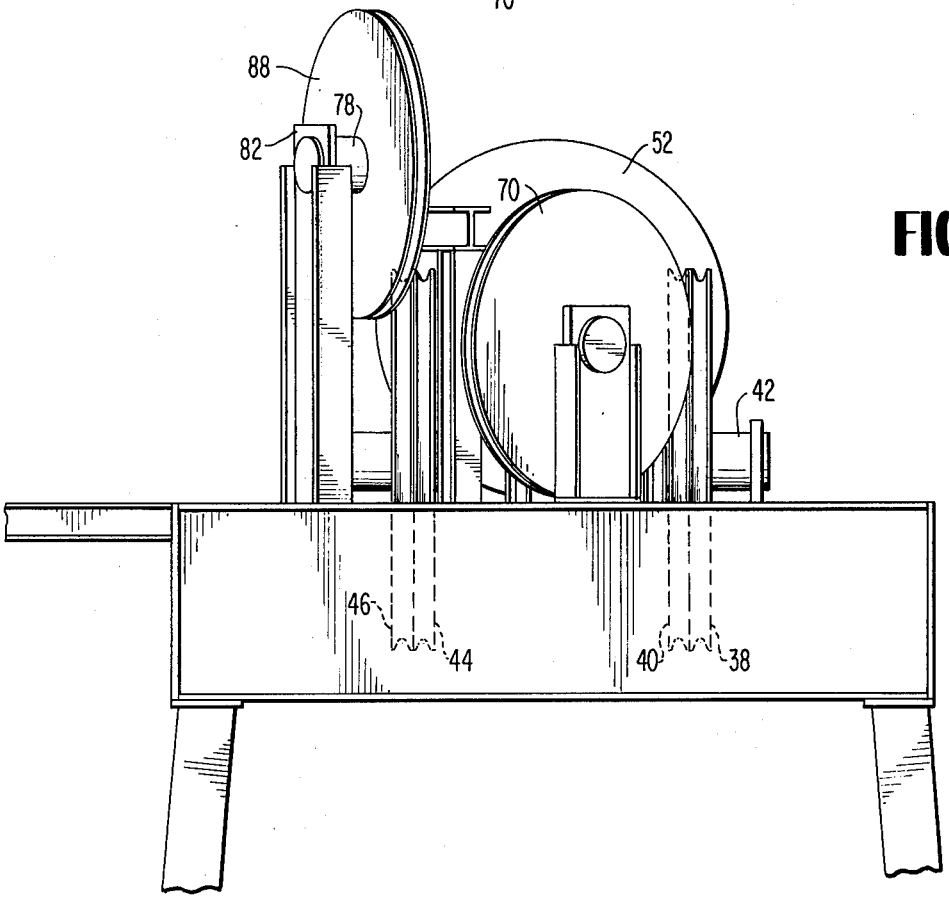
FIG. 3

CROWN BLOCK

The present invention relates to a crown block for use in masts (the term "mast" being used herein to describe a well drilling mast or a standard derrick) and particularly to a crown block having sheaves arranged to provide an open center for penetration by a heave compensator or other drilling tools.

In conventional drilling rigs, both on-land and offshore, the drilling line is attached to the drum of the draw works and extends over the crown block at the top of the mast. The drilling line is alternately reeved over the sheaves of the crown block and a travelling block with the end of the drilling line being deadended, i.e., anchored to the mast or its substructure. The crown block and travelling block thus support the drill string during drilling operations.

Most current crown blocks are centered along the well centerline and have four to six sheaves usually mounted in line on a common center pin. Earlier crown blocks had sheaves centered right angles to one another and center pins mounted at two different levels. In both cases, however, the components of the crown block substantially close the upper end of the mast along the centerline of the well. The location of the crown block along the centerline of the well and its substantial closing of the top of the mast are not particularly significant in land-based drilling rigs but become significant in offshore drilling rigs. It will be appreciated that floating offshore drilling rigs are subjected to vertical motions due to wind and wave action against the drilling vessel. It has proven desirable, however, to maintain the drill string substantially motionless in the vertical direction relative to the sea floor in order to permit continuous cutting action of the drill bit and prevent large compressive or buckling stresses on the drill string. Various devices are utilized to accomplish this, one of which is a heave compensator. A compensator may comprise an elongated cylinder secured to the travelling block with the piston of the cylinder secured to the drill string. By proper flow of hydraulic fluid to the cylinder, the motion of the vessel can be compensated with the result that the drill string remains substantially motionless in the vertical direction with its drill bit in substantial continuous engagement with the well bottom. However, this advantageous result is, in part, offset by the requirement for a taller mast since the cylinder of a compensator effective to eliminate vessel motions as a factor in maintaining the drill bit on bottom is usually quite long. That is, the travelling block utilizing an ordinary crown block and with a compensator attached to the travelling block cannot be raised adjacent the crown block during drilling operations. It has thus been recognized that the closing of the top of the mast by the crown block imposes a limitation upon the height of the travelling block above the rotary table and that it is therefore desirable to provide a crown block which is open along the well centerline such that the heave compensator or other drilling tools can penetrate through the crown block thereby eliminating the necessity of providing a taller mast.

The present invention provides a novel and improved crown block for a mast particularly useful in offshore drilling on vessels subject to wind and wave action causing motions in a vertical direction and which block is provided with an open center coincident with the well centerline to permit a heave compensator or other drilling tools to penetrate through the crown block. It will also be recognized, in providing a crown block of the foregoing type, that the travelling block must be retained on the well centerline and retained square relative to the mast. Accordingly, the present invention provides a crown block comprised of an open center frame having a pair of sheaves on each of the opposite sides of the frame leaving the center of the frame in vertical alignment with the well centerline open. A fastline sheave is carried by the frame on one side of the well centerline for transporting the drilling line from the draw works to a position in substantial vertical alignment with a sheave on the travelling block. A crossover sheave is provided on the side of the frame opposite the fastline sheave and transfers the drill line from one side of the well centerline to the opposite side of the well centerline. A deadline sheave is also carried on the frame and located to receive the drilling line from the travelling block whereby the line can be secured or anchored to the mast or its substructure.

In reeving the drilling line over the sheaves, the drilling line starts from the draw works and is reeved over the fastline sheave downwardly to the travelling block. The drilling line is then alternately reeved about a pair of sheaves on the crown block and three sheaves on the travelling block, all such sheaves lying on one side of the well centerline. The drilling line is then reeved over the transfer sheave for return to the travelling block on the opposite side of the well centerline. The drilling line is then alternately reeved about the pair of sheaves of the crown block and the three sheaves on the travelling block, all such latter sheaves lying on the opposite side of the well centerline. The drilling line is then received from the travelling block, reeved over the deadline sheave, and anchored to the drilling mast or its substructure. The pairs of sheaves on the crown block on opposite sides of the well centerline lie in oblique planes which converge to intersect in an acute angle. Also, the grooves of the fastline sheave, the crossover sheave and the deadline sheave lie in substantial vertical alignment with the sheaves of the travelling block for receiving or taking on the drilling line whereby the portions of the lines interconnecting the crown block sheaves and the travelling block sheaves lie substantially vertical relative to one another. In this manner the travelling block is free of forces tending to twist it relative to the mast or misalign it in a vertical direction whereby the travelling block is maintained square relative to the mast and in true vertical alignment with the well centerline and the crown block.

In accordance with the foregoing arrangement of the sheaves, an area of the crown block lying on the well centerline remains open. This area is bounded by the pairs of sheaves on opposite sides of the crown block frame, the crossover sheave and the fastline sheave. Also, the space above the travelling block is open and unencumbered by the drilling line. Accordingly, a heave compensator or any other tool carried by the travelling block can be received within the area above the travelling block and between the sheaves of the crown block. This enables the travelling block to be hoisted to the top portion of the mast with the result that the height of the mast effective to carry pipe is in no way shortened due to the use of a heave compensator or other drilling tool in the drill string.

Accordingly, it is a primary object of the present invention to provide a novel and improved open center crown block.

It is another object of the present invention to provide a novel and improved crown block having an open center for receiving a motion compensating cylinder or other drilling tool.

It is another object of the present invention to provide an open center crown block having an arrangement of sheaves which maintain the travelling block square relative to the mast and the portions of the drilling lines between the crown block and travelling block substantially vertically parallel relative to one another.

It is a further object of the present invention to provide a novel and improved open center crown block for use with masts carried by floating offshore drilling vessels.

It is a still further object of the present invention to provide a novel and improved crown block having an open center wherein the block can be readily and easily constructed and utilized.

These and other objects and advantages of the present invention will become more apparent upon reference to the following specification, appended claims and drawings wherein:

FIG. 2 is an enlarged plan view of the crown block hereof;

FIG. 3 is a side elevational view thereof;

Figure 1:
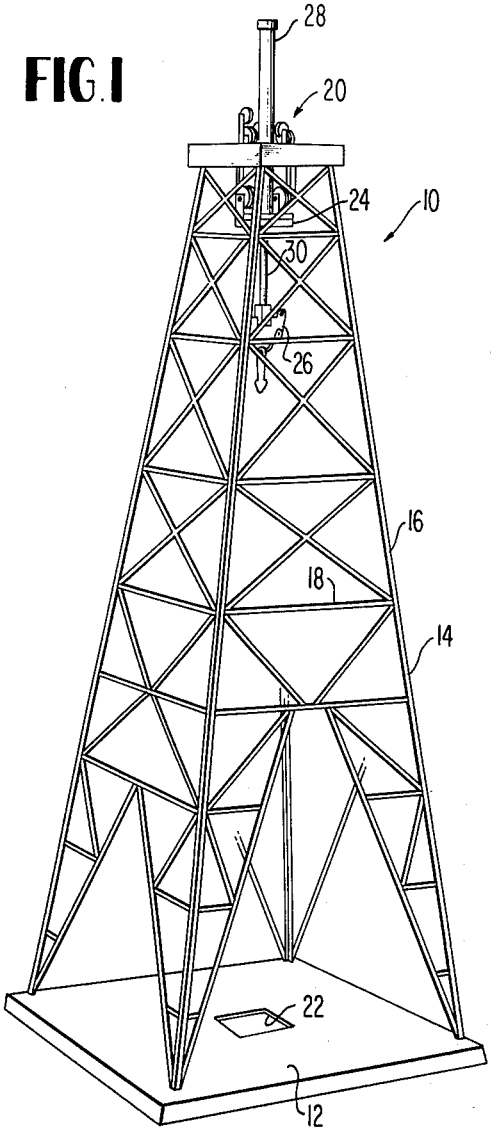
FIG. 1 is a perspective view of a drilling mast and illustrates a crown block constructed in accordance with the present invention supporting a travelling block having a heave compensating cylinder secured thereto.

Referring now to the drawings and particularly to FIG. 1, there is illustrated a drilling rig, generally designated 10, comprised of a derrick floor 12, and a mast 14 including derrick legs 16 and interconnecting diagonal and longitudinally extending braces 18. The mast 14 terminates its upper end in a crown block generally designated 20 and which crown block 20 is constructed in accordance with the present invention. The derrick floor 12 is provided with an opening 22 through which the drill string extends to the well bottom, the drill string being supported by derrick 10 from crown block 20. Particularly, the drill string is supported from crown block 20 by a travelling block 24 and a drilling line 90. Drilling line 90 is connected at one end to the draw works and is reeved over sheaves carried by the crown block and travelling block. The opposite end of the drilling line 90 is deadended to the mast 14 or its substructure. The drilling line 90 cooperates with the crown block 20 of the present invention and travelling block 24 to, in accordance with the present invention, leave the centerline of the derrick above the travelling block and through the crown block open, all as described hereinafter. In the illustration of the derrick in FIG. 1, there is provided a heave compensator designated 26 and which compensator is supported by the travelling block. It will be recalled that a heave compensator is necessary particularly in floating drilling rigs in order to maintain the drill bit on bottom notwithstanding heave motions of the vessel caused by wind and wave action on the vessel. The heave compensator 26 illustrated herein comprises a cylinder 28 secured to travelling block 24. The piston 30 of cylinder 28 is connected to a hook which, in turn, is connected through a swivel and a kelly to the drill string. In the usual operation of a heave compensator of this type the piston 30 moves into and out of the cylinder 28 in response to vessel heave motions thereby maintaining the drill string substantially vertically motionless relative to the sea bottom notwithstanding vertical motion of the derrick or mast 14 which is rigidly secured to the floating vessel.

Figure 4:
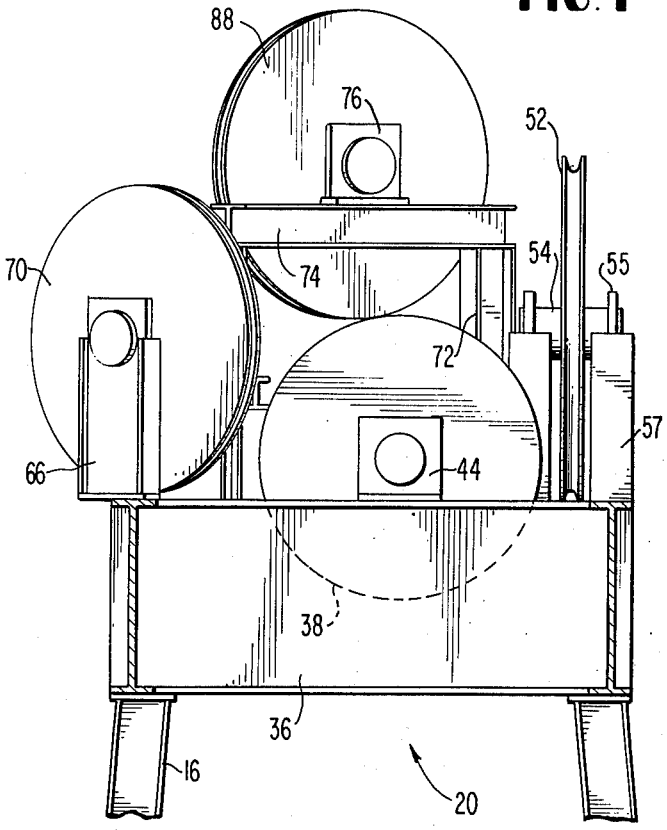
FIG. 4 is a cross-sectional view thereof taken generally about on line 4—4 in FIG. 2.

Turning now to particularly FIGS. 2, 3 and 4, there is illustrated a crown block 20 constructed in accordance with the present invention and including a framework having a pair of generally parallel side frame members 32 connected one to the other by end framing members, one of which is illustrated at 34. Between the end framing members and also connected between the side frame members 32 there are two pairs of spaced cross frame members 36, each pair of cross frame members 36 being spaced on opposite sides of the well centerline designated C.L. Thus, from a review of FIG. 2, it will be appreciated that a generally rectangular, vertically opening area is defined between the side frame members 32 and the cross frame members 36 through crown block 20. A pair of sheaves are mounted between the cross frame members 36 of each pair thereof on the opposite sides of the well centerline C.L. Specifically, a pair of sheaves 38 and 40 are carried on bearings, not shown, about a centerpin 42, the centerpin 42 being secured at opposite ends in blocks 43 mounted on cross members 36. Sheaves 44 and 46 are carried between the pair of cross members 36 on the opposite side of the well centerline and are likewise mounted on bearings, not shown, about a centerpin 48 similarly mounted in blocks 50 secured to cross members 36. Each pair of sheaves 38, 40 and 44, 46, are mounted obliquely relative to the end frame members 34. That is, these sheaves are mounted in converging planes which, if extended, intersect one another on one side of crown block 20.

Carried adjacent one side of crown block 20 is a crossover sheave 52 which lies in a plane generally parallel to a side frame member 32 of the crown block. Crossover sheave 52 similarly is carried by bearings, not shown, about a centerpin 54 secured at opposite ends to blocks 55. Blocks 55 are, in turn, secured to the upper ends of a pair of support brackets 57 which straddle sheave 52 and upstand respectively from side frame member 32 and a structural member 56. Member 56 is secured between the innermost cross frame members 36 on opposite sides of the well centerline and lies adjacent the side frame member 32. As illustrated in FIG. 4, the crossover sheave 52 is thus elevated above the two pairs of sheaves between cross frame members 36.

A pair of upstanding frame members 58 (FIG. 2) are secured at their lower ends respectively to the innermost cross frame member 36 on one side of the well centerline and the side frame member 32 opposite from the frame member 32 supporting crossover sheave 52. A cross member 60 is secured at the top of upstanding members 58 and carries a support block 62 for carrying one end of a centerpin 64. An upstanding support bracket 66 is also carried by side frame member 32 and carries a block 68 which supports the opposite end of centerpin 64. Centerpin 64 rotatably mounts on bearings, not shown, a fastline sheave 70. The fastline sheave 70 is, as illustrated in FIG. 2, rotatable in a plane which extends obliquely relative to the side frame member 32.

Located on one of the pairs of cross frame members 36 on one side of the well centerline and adjacent opposite side frame members 32, there is provided a pair of upstanding supports 72. Supports 72 carry a cross support 74 at their upper ends. Cross support 74 carries a block 76 for mounting one end of a centerpin 78. The opposite end of centerpin 78 is carried in a block 80 mounted at the upper end of an upstanding support 82 which is connected at its lower end to the outermost cross frame member 36 and a cross bracing member 84 extending between side frame member 32 and cross frame member 36. A deadline sheave 88 is rotatably mounted on centerpin 78 on suitable bearings, not shown. From a review of FIG. 2, it will be seen that the deadline sheave 88 is rotatable in a plane which extends obliquely relative to the side frame members 32.

From a review of FIG. 2, it will be appreciated that each of the sheaves 38, 40, 44, 46, 52, 70 and 88 are grooved to receive drilling line 90 (FIG. 5) and are arranged such that drilling line 90 can be reeved over the sheaves of the crown block and the sheaves of the travelling block. As noted previously, one end of line 90 is deadended to the mast or its substructure while its opposite end is coupled to the draw works, it being appreciated that the drilling line supports the travelling block and drill string from the crown block. It will also be apparent from a review of FIG. 2 and for reasons which will become apparent from the ensuing description, that the groove of the fastline sheave 70 lies in substantial vertical alignment with the groove of sheave 40. Similarly, the groove of sheave 38 lies in substantial vertical alignment with the groove on one side of crossover sheave 52 while the groove on the opposite side of crossover sheave 52 lies in substantial vertical alignment with the groove of sheave 46. Also, the groove of deadline sheave 88 lies in substantial vertical alignment with the groove carried by sheave 44.

Figure 5:
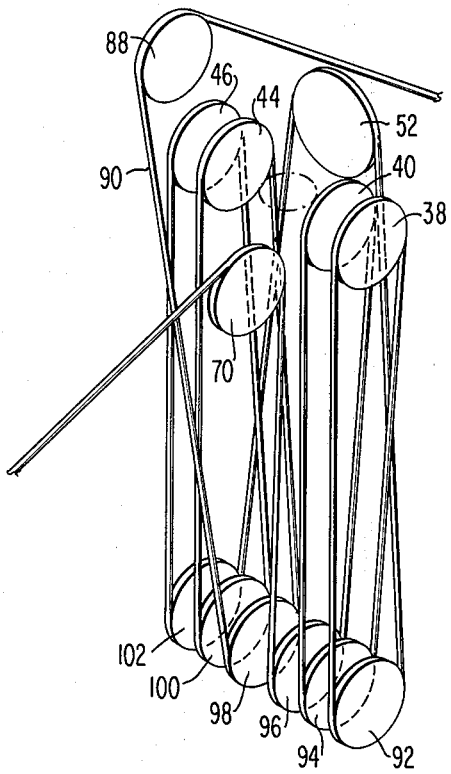
FIG. 5 is a schematic representation of the manner in which the drilling line is reeved about the sheaves of the crown block and travelling block.

Referring now to FIG. 5, there is represented, in schematic form, the arrangement of the drilling line 90 over the sheaves of the crown block and the sheaves of the travelling block. The sheaves on the travelling block are designated for clarity hereinafter by the numerals 92, 94, 96, 98, 100, and 102. It will be appreciated that the sheaves of the travelling block are normally mounted on tapered roller bearings which run on a centerpin secured in the body of the travelling block. Also, the six sheaves of the travelling block are divided into two sets of three sheaves each located on opposite sides of the travelling block and on opposite sides of the well centerline. The manner in which drill line 90 is reeved over the sheaves of crown block 20 and the sheaves of the travelling block 24 will now be described with reference to FIG. 5. The fastline taken from the draw works is first reeved over fastline sheave 70 and extends to the travelling block for reeving about on interior sheave 96 on one side of the travelling block and the well centerline. The line 90 then extends upwardly from sheave 96 and over interior sheave 40 of the crown block on the like side of the well centerline. The line 90 from sheave 40 extends downwardly and about sheave 94 of travelling block 24. Line 90 then extends upwardly from sheave 94 and about sheave 38 of the crown block. Line 90 then extends from sheave 38 downwardly and about the outside sheave 92 of travelling block whereupon line 90 again extends upwardly. Line 90 is then reeved over crossover sheave 52. It will be appreciated that the foregoing detailed arrangement of the drilling line over sheaves 92, 94, and 96 of the travelling block and sheaves 38 and 40 of the crown block is provided solely on one side of the well centerline and that crossover sheave 52 transfers line 90 over to the opposite side of of the mast. This transfer, as illustrated in FIG. 2, is accomplished directly adjacent one side of the mast. Drilling line 90 then extends downwardly from crossover sheave 52 and about the outermost sheave 102 of the travelling block. Drilling line 90 then extends upwardly from sheave 102 and about the outermost sheave 46 of crown block. Line 90 then extends downwardly about sheave 100 of the travelling block and then upwardly again about sheave 44 of the crown block. Line 90 then extends downwardly about sheave 98 of the travelling block and then upwardly about the deadline sheave 88. The end of the drilling line from sheave 88 is deadended to the mast 14 or its substructure.

It will be appreciated that in the actual construction of the crown block and travelling block and due to the intricacies of this construction, the grooves of the outermost sheaves 92 and 102 of the travelling block are slightly offset outwardly from respective true verticals with the diametrically opposed grooves of the crossover sheave 52. These offsets are, however, equal in lateral distance and in opposite directions. Similarly the grooves of the fastline sheave 70 and the deadline sheave 88 are slightly laterally offset from the respective grooves of the opposed innermost sheaves 96 and 98 of the travelling block. These offsets are likewise equal in lateral distance relative to one another and in opposite directions. The foregoing described offsets thus maintain the travelling block square relative to the crown block and throughout the full range of vertical movement of the travelling block within the mast. That is, the winding of the drilling line does not by itself develop forces tending to twist the travelling block relative to the crown block or tending to move the travelling block from a true vertical relative to the crown block.

It will thus be appreciated from the foregoing description that the area vertically above the travelling block and between the two sets of sheaves carried thereby lies open and is unencumbered by any portions of the drilling line 90 crossing over such space. Also, the central portion of the crown block remains open and unencumbered by any portion of the drilling line or support structure therefor. Thus a heave compensator of the type illustrated in FIG. 1 and wherein the cylinder 28 of the compensator extends above the travelling block may be carried within the mast unencumbered by the drilling line 90 or the sheaves of the crown block and for reception within the opening in the crown block. The open center crown block and the open area above the travelling block thus serves to limit the height of the derrick while simultaneously enabling disposition of a heave compensator in a manner which does not foreshorten the effective height of the derrick and also in a manner which permits other drilling tools to be inserted through the crown block and into the drilling string or mast.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A crown block for use in well drilling apparatus having a mast, draw works and a travelling block comprising:

a frame having an open center in substantial vertical registration with the centerline of a well being drilled and adapted for mounting adjacent the top of the mast, a pair of sheaves carried by said frame on each of the opposite sides of the open center of said frame and adapted to reeve a drilling line thereabout and about the sheaves of a travelling block supported by the mast from said crown block, the pair of sheaves on one side of the open center of the frame lying on a common axis and the pair of sheaves on the other side of the open center of the frame lying on a common axis, a cross-over sheave carried by said frame for transferring the drilling line from the pair of sheaves on one side of the open center of said frame to the pair of sheaves on the other side of the open center of said frame, said cross-over sheave being spaced from the open center of said frame and located adjacent an edge of said frame, each of said pairs of sheaves being obliquely mounted relative to a side edge of said frame whereby planes containing a sheave of each pair thereof intersect at an acute angle on the side of said frame adjacent to which said cross-over sheave is mounted, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said cross-over sheave is located for reeving the drilling line from the draw works to a sheave carried by the travelling block, said fastline sheave and said deadline sheave being spaced from the open center of said frame and being obliquely mounted relative to a side edge of said frame and to planes containing said pairs of sheaves whereby planes containing said fastline sheave and said deadline sheave intersect at an acute angle to one side of said frame, the axes of said pairs of sheaves, said deadline sheave and said fastline sheave lying at different elevations in said crown block with the plane of operation of the deadline sheave intersecting the plane of operation of at least one of the pair of sheaves on one side of the open center of said block along a vertical line intersecting each said deadline sheave and the one sheave of the latter pair of sheaves.

2. A crown block according to claim 1 wherein said fastline sheave has a groove in substantial vertical alignment with the groove of one of the pairs of sheaves on one side of the open center of the frame to maintain the portions of the drilling lines between the crown and travelling blocks generally parallel.

3. A crown block according to claim 1 wherein said crossover sheave has diameterically opposed grooves in respective substantial vertical alignment with the grooves of respective sheaves of said pairs of sheaves.

4. A crown block according to claim 1 wherein said deadline sheave has a groove in substantial vertical alignment with a groove of one of the pairs of sheaves on one side of the open center of said frame.

5. A crown block according to claim 1 wherein said fastline sheave has a groove in substantial vertical alignment with the groove of one of the pairs of sheaves on one side of the open center of said frame to maintain portions of the drilling line between the crown block and travelling block generally parallel, said crossover sheave having diametrically opposed grooves in respective substantially vertical alignment with the grooves of respective sheaves of said pairs of sheaves.

6. A crown block according to claim 1 wherein said crossover sheave has diametrically opposed grooves in respective substantial vertical alignment with the grooves of respective sheaves of said pairs of sheaves, said deadline sheave having a groove in substantially vertical alignment with a groove of one of the pairs of sheaves on one side of the open center of said frame.

7. A crown block for use in well drilling apparatus having a mast, draw works and a travelling block comprising:

a frame having an open center in substantial vertical registration with the centerline of a well being drilled and adapted for mounting adjacent the top of the mast, a pair of sheaves carried by said frame on each of the opposite sides of the open center of said frame and adapted to reeve a drilling line thereabout and about the sheaves of a travelling block supported by the mast from said crown block, the pair of sheaves on one side of the open center of the frame lying on a common axis and the pair of sheaves on the other side of the open center of the frame lying on a common axis, a cross-over sheave carried by said frame for transferring the drilling line from the pair of sheaves on one side of the open center of said frame to the pair of sheaves on the other side of the open center of said frame, said cross-over sheave being spaced from the open center of said frame and located adjacent an edge of said frame, each of said pairs of sheaves being obliquely mounted relative to a side edge of said frame whereby planes containing a sheave of each pair thereof intersect at an acute angle on the side of said frame adjacent to which said cross-over sheave is mounted, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said cross-over sheave is located for reeving the drilling line from the draw works to a sheave carried by the travelling block, said fastline sheave and said deadline sheave being spaced from the open center of said frame and being obliquely mounted relative to a side edge of said frame and to planes containing said pairs of sheaves whereby planes containing said fastline sheave and said deadline sheave intersect at an acute angle to one side of said frame, said fastline sheave having a groove in substantially vertical alignment with the groove of one of the pairs of sheaves on one side of the open center of said frame to maintain portions of the drilling line between the crown and travelling blocks generally parallel, said crossover sheave having diametrically opposed grooves in respective substantially vertical alignment with the grooves of respective sheaves of said pairs of sheaves, said deadline sheave having a groove in substantially vertical alignment with a groove of the other of the pairs of sheaves on the other side of the open center of said frame, the axes of said pairs of sheaves, said deadline sheave and said fastline sheave lying at different elevations relative to one another along said crown block, the axis of said crossover sheave lying at a different elevation along said crown block relative to each of said deadline sheave, said fastline sheave and said pairs of sheaves.

8. Well drilling apparatus comprising: a mast, a crown block secured to said mast adjacent the top of the mast, a travelling block having a set of sheaves of three sheaves each on each of the opposite sides of the vertical center of the travelling block, a drilling line coupled between said travelling block and said crown block, said crown block including a frame having an open center in substantial registration with the vertical centerline of a well being drilled and in substantial vertical registration with the center of said travelling block, a pair of sheaves carried by said frame on each of the opposite sides of the open center of said frame, a cross-over sheave carried by said crown block frame adjacent an edge of said frame and spaced from the open center of said frame, a deadline sheave carried by said frame adjacent an edge thereof, a fastline sheave carried by said frame adjacent an edge thereof opposite the frame edge adjacent to which said crossover sheave is located for reeving a portion of the drilling line from a draw works, said fastline sheave and said deadline sheave being spaced from the open center of said frame, said drilling line being reeved over said fastline sheave and extending downwardly and reeved over the innermost sheave on one side of the travelling block for return to the innermost sheave of the pair of sheaves on a like side of said crown block, said drilling line extending downwardly from the latter sheave and reeved over the intermediate sheave on said one side of the travelling block for return to the outermost sheave of the pair of sheaves on the like side of said crown block, said drilling line extending downwardly from the latter sheave and reeved over the outermost sheave of said one side of the travelling block for return to the crossover sheave on said one side of the crown block, said drilling line being transferred by said crossover sheave from said one side of the crown block and well centerline to the opposite side of the crown block and well centerline, said drilling line extending downwardly from said crossover sheave on the other side of said crown block and well centerline and reeved over the outermost sheave on the other side of said travelling block for return to the outermost sheave of the pair of sheaves on the other side of said crown block, said drilling line extending downwardly from the latter outermost sheave and reeved over the intermediate sheave on the other side of the travelling block for return to the innermost sheave on said other side of said crown block, said drilling line extending downwardly from the latter sheave and reeved over the innermost sheave on said other side of the travelling block for return to the deadline sheave, the drilling line being reeved over the deadline sheave and directed thereby for securement to the drilling apparatus, said fastline sheave and said deadline sheave being angularly oriented such that entry of said drilling line to the crown block over said fastline sheave and exit of said drilling line from said deadline sheave lie on substantially opposite sides of said crown block.

9. A crown block according to claim 8 wherein the grooves of the outmost sheave on each of the opposite sides of the travelling block are laterally offset from true vertical alignment with the respective diametrically opposed grooves of said crossover sheave, said offsets being equal in magnitude and in opposite directions whereby said travelling block is maintained square relative to said crown block.

10. A crown block according to claim 8 wherein the grooves of said fastline sheave and said deadline sheave are laterally offset from true vertical alignment with the respective grooves of the innermost sheave on each of the opposite sides of the travelling block, said offsets being equal in magnitude and in opposite directions whereby said travelling block is maintained square relative to said crown block.

11. A crown block according to claim 8 wherein the grooves of the outermost sheave on each of the opposite sides of the travelling block are laterally offset from true vertical alignment with the respective diametrically opposed grooves of said crossover sheave, said offsets being equal in magnitude and in opposite directions, the grooves of said fastline sheave and said deadline sheave being laterally offset from true vertical alignment with the respective grooves of the innermost sheave on each of the opposite sides of the travelling block, the latter mentioned offsets being equal in magnitude and in opposite directions relative to one another, whereby said travelling block is maintained square relative to said crown block.

12. Well drilling apparatus according to claim 8 wherein the pair of sheaves on one side of the open center of the frame lie on a common axis and the pair of sheaves on the other side of the open center of the frame lie on a common axis, each pair of sheaves being obliquely mounted relative to a side edge of said frame whereby planes containing a sheave of each pair thereof intersect at acute angle on the side of said frame adjacent to which said crossover sheave is mounted, said fastline sheave and said deadline sheave being obliquely mounted relative to a side edge of said frame and to planes containing said pairs of sheaves whereby planes containing said fastline sheave and said deadline sheave intersect at an acute angle to one side of said frame.

13. Well drilling apparatus according to claim 12 wherein the latter mentioned planes intersect on the side of said frame opposite from the side of said frame adjacent to which the first mentioned planes intersect, said crossover sheave lying in a plane extending generally parallel to one side of said frame.

14. Well drilling apparatus according to claim 12 wherein said fastline sheave has a groove in substantially vertical alignment with the groove of one of the pairs of sheaves on one side of the open center of said frame to maintain portions of the drilling line between the crown block and travelling blocks generally parallel, said crossover sheave having diametrically opposed grooves in respective substantially vertical alignment with the grooves of respective sheaves of said pairs of sheaves, said deadline sheave having a groove in substantial alignment with the groove of the other of the pairs of sheaves on the other side of the open center of said frame, the axis of said pairs of sheaves, said deadline sheave and said fastline sheave lying at different elevations relative to one another along said crown block, the axis of said crossover sheave lying at a different elevation along said crown block relative to each of said deadline sheave, said fastline sheave and said pairs of sheaves, the pairs of sheaves on one side of the open center of the frame lying on a common axis and the pair of sheaves on the other side of the open center of the frame lying on a common axis, each pair of sheaves being obliquely mounted relative to a side edge of said frame whereby planes containing a sheave of each pair thereof intersect at an acute angle to one side of said frame, said planes intersecting on the side of said frame adjacent to which said crossover sheave is mounted, said fastline sheave and said deadline sheave being obliquely mounted relative to a side edge of said frame whereby planes containing said fastline sheave and said deadline sheave intersect at an acute angle to one side of said frame, the latter mentioned planes intersecting on the side of said frame opposite from the side of said frame adjacent to which the first mentioned planes intersect, said crossover sheave lying in a plane extending generally parallel to one side of said frame.

15. A crown block for use in well drilling apparatus having a mast, draw works and a travelling block comprising:

a frame having an open center in substantial vertical registration with the centerline of a well being drilled and adapted for mounting adjacent the top of the mast, a pair of sheaves carried by said frame on each of the opposite sides of the open center of said frame and adapted to reeve a drilling line thereabout and about the sheaves of a travelling block supported by the mast from said crown block, a crossover sheave carried by said frame for transferring the drilling line from the pair of sheaves on one side of the open center of said frame to the pair of sheaves on the other side of the open center of said frame, said crossover sheave being spaced from the open center of said frame and located adjacent an edge of said frame, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said crossover sheave is located for reeving the drilling line from the draw works to a sheave carried by the travelling block, said fastline sheave and said deadline sheave being spaced from the open center of said frame, said fastline sheave having a groove in substantially vertical alignment with the groove of one of the pairs of sheaves on one side of the open center of said frame to maintain portions of the drilling line between the crown and travelling blocks generally parallel, said crossover sheave having diametrically opposed grooves in respective substantially vertical alignment with the grooves of respective sheaves of said pairs of sheaves, said deadline sheave having a groove in substantially vertical alignment with a groove of the other of the pairs of sheaves on the other side of the open center of said frame, the axes of said pairs of sheaves, said deadline sheave and said fastline sheave lying at different elevations relative to one another along said crown block, the axis of said crossover sheave lying at a different elevation along said crown block relative to each of said deadline sheave, said fastline sheave and said pairs of sheaves, the pair of sheaves on one side of the open center of the frame lying on a common axis and the pair of sheaves on the other side of the open center of the frame lying on a common axis, each pair of sheaves being obliquely mounted relative to a side edge of said frame whereby planes containing a sheave of each pair thereof intersect at an acute angle to one side of said frame, said planes intersecting on the side of said frame adjacent to which said crossover sheave is mounted, said fastline sheave and said deadline sheave being obliquely mounted relative to a side edge of said frame whereby planes containing said fastline sheave and said deadline sheave intersect at an acute angle to one side of said frame, the latter mentioned planes intersecting on the side of said frame opposite from the side of said frame adjacent to which the first mentioned planes intersect, said crossover sheave lying in a plane extending generally parallel to one side of said frame.

16. A crown block for use in well drilling apparatus having a mast, draw works and a travelling block comprising:

a frame adapted for mounting adjacent the top of the mast and having an open center and a centerline within said open center in substantial vertical registration with the centerline of a well being drilled, a pair of sheaves of predetermined equal diameter carried by said frame on each of the opposite sides of the open center of said frame substantially equidistantly from the opposite sides of the frame centerline and adapted to reeve a drilling line thereabout and about the sheaves of a travelling block supported by the mast from said crown block, a cross-over sheave having a diameter greater than the predetermined diameter of the sheaves comprising said pairs thereof and carried by said frame for transferring the drilling line from the pair of sheaves on one side of the open center of said frame to the pair of sheaves on the other side of the open center of said frame, said cross-over sheave being spaced from the open center of said frame and located adjacent an edge of said frame, the closest spacing between the innermost sheaves of said pairs of sheaves in a direction parallel to a plane containing said cross-over sheave being greater than at least one half their predetermined diameters, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said cross-over sheave is located for reeving the drilling line from the draw works to a sheave carried by the travelling block, said fastline sheave and said deadline sheave being spaced from the open center of said frame, the pair of sheaves on one side of the open center of the frame lying on a common axis and the pair of sheaves on the other side of the open center of the frame lying on a common axis, each pair of sheaves being obliquely mounted relative to a side edge of said frame whereby planes containing a sheave of each pair thereof intersect at an acute angle on the side of said frame adjacent to which said cross-over sheave is mounted, said fastline sheave and said deadline sheave being obliquely mounted relative to a side edge of said frame and to planes containing said pairs of sheaves whereby planes containing said fastline sheave and said deadline sheave intersect at an acute angle to one side of said frame.

17. A crown block according to claim 16 wherein the latter mentioned planes intersect on the side of said frame opposite from the side of said frame adjacent to which the first mentioned planes intersect, said cross-over sheave lying in a plane extending generally parallel to one side of said frame.

18. A crown block according to claim 16 wherein the axes of said pairs of sheaves, said deadline sheave and said fastline sheave lie at different elevations in said crown block with the plane of operation of the deadline sheave intersecting the plane of operation of at least one of the pair of sheaves on one side of the open center of said block along a vertical line intersecting each said deadline sheave and the one sheave of the latter pair of sheaves.

19. A crown block according to claim 16 wherein said fastline sheave has a groove in substantial vertical alignment with the groove of one of the pairs of sheaves on one side of the open center of the frame to maintain the portions of the drilling lines between the crown and travelling blocks generally parallel.

20. A crown block according to claim 16 wherein said crossover sheave has diametrically opposed grooves in respective substantial vertical alignment with the grooves of respective sheaves of said pairs of sheaves.

21. A crown block according to claim 16 wherein said deadline sheave has a groove in substantial vertical alignment with a groove of one of the pairs of sheaves on one side of the open center of said frame.

22. A crown block according to claim 16 wherein said fastline sheave has a groove in substantial vertical alignment with the groove of one of the pairs of sheaves on one side of the open center of said frame to maintain portions of the drilling line between the crown block and travelling block generally parallel, said crossover sheave having diametrically opposed grooves in respective substantially vertical alignment with the grooves of respective sheaves of said pairs of sheaves.

23. A crown block according to claim 16 wherein said crossover sheave has diametrically opposed grooves in respective substantial vertical alignment with the grooves of respective sheaves of said pairs of sheaves, said deadline sheave having a groove in substantially vertical alignment with a groove of one of the pairs of sheaves on one side of the open center of said frame.

24. A crown block for use in well drilling apparatus having a mast, draw works and a travelling block comprising:

a frame adapted for mounting adjacent the top of the mast and having an open center and a centerline within said open center in substantial vertical registration with the centerline of a well being drilled, a pair of sheaves of predetermined equal diameter carried by said frame on each of the opposite sides of the open center of said frame substantially equidistantly from the opposite sides of the frame centerline and adapted to reeve a drilling line thereabout and about the sheaves of a travelling block supported by the mast from said crown block, a cross-over sheave having a diameter greater than the predetermined diameter of the sheaves comprising said pairs thereof and carried by said frame for transferring the drilling line from the pair of sheaves on one side of the open center of said frame to the pair of sheaves on the other side of the open center of said frame, said crossover sheave being spaced from the open center of said frame and located adjacent an edge of said frame, the closest spacing between the innermost sheaves of said pairs of sheaves in a direction parallel to a plane containing said cross-over sheave being greater than at least one half their predetermined diameters, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said cross-over sheave is located for reeving the drilling line from the drill works to a sheave carried by the travelling block, said fastline sheave and said deadline sheave being spaced from the open center of said frame, said fastline sheave having a groove in substantially vertical alignment with the groove of one of the pairs of sheaves on one side of the open center of said frame to maintain portions of the drilling line between the crown and travelling blocks generally parallel, said crossover sheave having diametrically opposed grooves in respective substantial vertical alignment with the grooves of respective sheaves of said pairs of sheaves, said deadline sheave having a groove in substantially vertical alignment with a groove of the other of the pairs of sheaves on the other side of the open center of said frame, the axes of said pairs of sheaves, said deadline sheave and said fastline sheave lying at different elevations relative to one another along said crown block.

25. A crown block according to claim 24 wherein the axis of said crossover sheave lies at a different elevation along said crown block relative to each of said deadline sheave, said fastline sheave and said pairs of sheaves.

26. A crown block according to claim 25 wherein the pair of sheaves on one side of the open center of the frame lie on a common axis and the pair of sheaves on the other side of the open center of the frame lie on a common axis, each pair of sheaves being obliquely mounted relative to a side edge of said frame whereby planes containing a sheave of each pair thereof intersect at an acute angle to one side of said frame, said planes intersecting on the side of said frame ajacent to which said crossover sheave is mounted, said fastline sheave and said deadline sheave being obliquely mounted relative to a side edge of said frame whereby planes containing said fastline sheave and said deadline sheave intersect at an acute angle to one side of said frame, the latter mentioned planes intersecting on the side of said frame opposite from the side of said frame adjacent to which the first mentioned planes intersect, said crossover sheave lying in a plane extending generally parallel to one side of said frame.

27. A crown block for use in well drilling apparatus having a mast, draw works and a travelling block comprising:

a frame having an open center in substantial vertical registration with the centerline of a well being drilled and adapted for mounting adjacent the top of the mast, a pair of sheaves carried by said frame on each of the opposite sides of the open center of said frame and adapted to reeve a drilling line thereabout and about the sheaves of a travelling block supported by the mast from said crown block, the pair of sheaves on one side of the open center of the frame lying on a common axis and the pair of sheaves on the other side of the open center of the frame lying on a common axis, a cross-over sheave carried by said frame for transferring the drilling line from the pair of sheaves on one side of the open center of said frame to the pair of sheaves on the other side of the open center of said frame, said cross-over sheave being spaced from the open center of said frame and located adjacent an edge of said frame, each of said pairs of sheaves being obliquely mounted relative to a side edge of said frame whereby planes containing a sheave of each pair thereof intersect at an acute angle on the side of said frame adjacent to which said cross-over sheave is mounted, a deadline sheave carried by said frame adjacent an edge thereof for reeving the drilling line from the travelling block and directing the line for securement to the drilling apparatus, a fastline sheave carried by said frame adjacent an edge thereof opposite the frame edge adjacent to which said cross-over sheave is located for reeving the drilling line from the draw works to a sheave carried by the travelling block, said fastline sheave and said deadline sheave being spaced from the open center of said frame and being obliquely mounted relative to a side edge of said frame and to planes containing said pairs of sheaves whereby planes containing said fastline sheave and said deadline sheave intersect at an acute angle to one side of said frame, said fastline sheave having a groove in substantially vertical alignment with the groove of one of the pairs of sheaves on one side of the open center of said frame to maintain portions of the drilling line between the crown and travelling blocks generally parallel, said crossover sheave having diametrically opposed grooves in respective substantially vertical alignment with the grooves of respective sheaves of said pairs of sheaves, said deadline sheave having a groove in substantially vertical alignment with a groove of the other of the pairs of sheaves on the other side of the open center of said frame, the axes of said pairs of sheaves, said deadline sheave and said fastline sheave lying at different elevations relative to one another along said crown block with the plane of operation of the deadline sheave intersecting the plane of operation of at least one of the pair of sheaves on one side of the open center of said block along a vertical line intersecting each said deadline sheave and the one sheave of the latter pair of sheaves.

* * * * *